US007260228B2

(12) United States Patent
Hughes et al.

(10) Patent No.: US 7,260,228 B2
(45) Date of Patent: Aug. 21, 2007

(54) OPTIMUM DRIVER SPACING FOR A LINE ARRAY WITH A MINIMUM NUMBER OF RADIATING ELEMENTS

(75) Inventors: Charles Emory Hughes, Milford, PA (US); Kirk Samuel Lombardo, Milford, PA (US)

(73) Assignee: Altec Lansing, a division of Plantronics, Inc., Milford, PA (US)

( * ) Notice: Subject to any disclaimer, the term of this patent is extended or adjusted under 35 U.S.C. 154(b) by 0 days.

(21) Appl. No.: 10/796,199

(22) Filed: Mar. 10, 2004

(65) Prior Publication Data

US 2005/0201582 A1 Sep. 15, 2005

(51) Int. Cl.
*H04R 5/02* (2006.01)

(52) U.S. Cl. ..... 381/89; 381/182; 381/387

(58) Field of Classification Search ..... 381/335, 381/82, 332, 387; 181/144
See application file for complete search history.

(56) References Cited

U.S. PATENT DOCUMENTS 4,363,115 A 12/1982 Cuomo ..... 367/154
4,653,606 A * 3/1987 Flanagan ..... 181/145
4,991,687 A * 2/1991 Oyaba et al. ..... 181/145
5,359,664 A * 10/1994 Steuben ..... 381/336
5,568,560 A * 10/1996 Combest ..... 381/99
6,128,395 A * 10/2000 De Vries ..... 381/387

* cited by examiner

*Primary Examiner*—Daniel Swerdlow
(74) *Attorney, Agent, or Firm*—Richard E. Kurtz; Greenberg Traurig, LLP

(57) ABSTRACT

The loudspeaker has a first pair of drivers arranged in a line, a center point along the line, wherein the pair of drivers are substantially centered about the center point with a center to center distance, $d_0$, between the drivers in the first pair of drivers, whereby the maximum frequency with out high amplitude side lobes is equal to $c/2d_0$, and at least a subsequent pair of drivers arranged in the line array with the first pair of drivers and substantially centered about the center point, wherein the subsequent pair of drivers are spaced such that the center to center distance between each driver in the subsequent pair, $d_n$, is equal to $4nd_0$, where n=0 at the innermost pair of drivers and n increases by 1 with each pair of drivers sequentially added. Each pair of drivers for n>0 has a first order low pass filter with a frequency equal to $2c/d_n$.

13 Claims, 6 Drawing Sheets

OPTIMUM DRIVER SPACING FOR A LINE ARRAY WITH A MINIMUM NUMBER OF RADIATING ELEMENTS

FIELD OF THE INVENTION

The present invention relates generally to loudspeaker directivity, and more specifically to an arrangement of drivers and related filter functions for optimizing loudspeaker directivity.

BACKGROUND

A direct radiating loudspeaker typically has a set of transducers, i.e., drivers, on the baffle, i.e., front panel, of the speaker enclosure and directly face an intended audience. Ideally, the soundwaves from these drivers emanate in the direction of the intended audience. Directivity measures the directional characteristic of the soundwaves. Directivity indicates how much sound is directed toward a specific area compared to all of the sound energy being generated by a sound source. Loudspeakers with a high directivity, i.e., propagating in a particular direction and not in other directions, can be heard clearer by the intended audience. In a reverberant space, loudspeakers with low directionality, i.e., propagating in all directions, only contribute to the reverberant field. The conventional loudspeaker takes a "shotgun" approach, scattering sound in an uncalculated manner across the room. High frequency sound reverberates off the floors and ceilings, resulting in an imperfect sound. Note, however, that low frequency sounds, such as bass, are omni-directional. Omni-directional sounds disperse in every direction. Adding more speakers may lower the directionality and make the sound volume and quality even worse.

A line array of equally spaced similar drivers may exhibit a more narrow radiation pattern or beamwidth, in a plane containing the line and normal to the baffle in which the drivers are mounted, than a single driver. The higher frequency sounds emanating from a loudspeaker consists of a main lobe and side lobes. Beamwidth is measured as the included angle of one-quarter power (−6 dB) points of the main lobe projection. A smaller beamwidth angle is directly proportional to higher directivity. Without corrective filtering, the beamwidth of a line array becomes increasingly narrower with increasing frequency. The frequency at which the narrowing of the beamwidth begins to occur is a function of the length of the line array.

There are several problems with the narrowing of the beamwidth. One problem is that the beamwidth, in the plane of the line array, is not constant as a function of frequency. Another problem is that a large number of radiating elements or drivers, must be used in order to obtain a line array with sufficient length to get directivity control of a sufficiently low frequency. Conventional devices using line arrays have not sufficiently addressed these problems.

U.S. Pat. No. 4,363,115 to Cuomo discloses a method for determining optimum element spacing for a low frequency, log-periodic acoustic line array comprising a plurality of omnidirectional hydrophones arranged in a line wherein the spacing between the hydrophones is based on a logarithmic relationship using multiple dipole pairs, each pair centered about the acoustic axis of the array, such that the distance between each dipole pair bears a constant ratio to the wavelength of the acoustic frequency band to be investigated by that hydrophone pair. However, each hydrophone pair operates within a preselected frequency band, exclusive from the other hydrophone pairs.

U.S. Pat. No. 4,653,606 to Flanagan discloses an electroacoustic device with broad frequency range directional response. The array comprises a set of equispaced transducer elements with one element at the center and an odd number of elements in each row and each column. The device uses second order, i.e., 12 dB per octave, filtering of the transducer elements. Beamwidth variations are minimized over the desired frequency range by decreasing the size of the array as the incident sound frequency increases. This is realized by reducing the number of active receiver elements as frequency increases, starting with the extremities of the array. However, the second order filtering of equispaced transducer elements does not provide ideal loudspeaker directivity.

U.S. Pat. No. 6,128,395 to De Vries discloses a loudspeaker system with controlled directional sensitivity. The loudspeakers have a mutual spacing, which, insofar as physically possible, substantially corresponds to a logarithmic distribution, wherein the minimum spacing is determined by the physical dimensions of the loudspeakers used. The frequency dependent variation is inversely proportional to the number of loudspeakers per octave band and is 50% for a distribution of one loudspeaker per octave. However, the logarithmic spacing and delay function does not provide ideal loudspeaker directivity.

A desired loudspeaker arrangement minimizes the number of drivers needed by optimizing the spacing of the drivers and driving function for consistent directivity.

SUMMARY OF THE INVENTION

A loudspeaker with a line array of drivers with consistent directivity control as a function of frequency may be constructed with a minimum number of radiating elements. This is accomplished via optimum spacing and driving function of the radiating elements. The present application utilizes a spacing arrangement of the radiating elements in an array that is neither logarithmic nor equidistantly spaced. Rather, the spacing of each pair of drivers increases along the array by a factor of 4n. The mid-point of each pair is coincident with the center of the array. For the same number of drivers, this spacing provides a lower frequency to which directivity control is maintained than equally spaced drivers. Similarly, fewer drivers are required to maintain directivity control to the same low frequency limit.

The loudspeaker has a first pair of drivers arranged in a line array; a center point along the line array, wherein the pair of drivers are substantially centered about the center point with a center to center distance of $d_0$ between the first pair of drivers whereby the maximum frequency desired by a user is equal to $c/2d_0$; and at least a subsequent pair of drivers arranged in the line array with the first pair of drivers and substantially centered about the center point, wherein the subsequent pair of drivers are spaced such that the distance between the center points of each driver in the subsequent pair, $d_n$, is equal to $4nd_0$, where n=0 at the innermost pair of drivers and n increases by 1 with each pair of drivers sequentially added along the array. The loudspeaker further comprises a low pass filter on each pair of drivers for n>0. Preferably, the low pass filter is first order. In one embodiment of the present invention, the low pass filter on the outermost pair of drivers in the array has a lower frequency than calculated for that particular pair of drivers. This spacing arrangement minimizes the number of drivers needed in the line array. The loudspeaker may further comprise an additional driver centered on the center point of the line array.

A transducer spacing arrangement in an array comprises a first pair of transducers having a first distance, $d_0$, between the center points of the first pair of transducers, a second pair of transducers arranged in the array with the first pair of transducers and having a second distance, $d_1$, between the center points of the second pair of transducers, wherein the midpoint of $d_0$ is the same midpoint of $d_1$, wherein the second distance, $d_1$, is equal to $4d_0$, and a low pass filter of first order on the second pair of transducers. The transducer spacing arrangement further comprises at least a third pair of transducers arranged in the array with the first pair of transducers and having a distance, $d_n$, between the center points of the at least a third pair of transducers, wherein the midpoint of $d_0$ is the same midpoint as $d_n$, and wherein the distance, $d_n$, is equal to $4nd_0$ where n=0 at the innermost pair of drivers and n increases by 1 with each pair of drivers sequentially added along the array. In one embodiment of the invention the transducer spacing arrangement, $d_0$ is 1.2 inches, $d_1$ is 4.8 inches, and $d_2$ is 9.6 inches. The transducer spacing arrangement may further comprise an additional transducer at the midpoint of $d_0$. The transducer spacing arrangement further comprises a low pass filter of first order on the at least a third pair of transducers. In one embodiment of the invention, the outermost pair of transducers in the array has a lower frequency than calculated for the outermost pair of transducers.

A method for optimizing a radiation pattern of drivers in a line on a loudspeaker comprises the steps of selecting a spacing, $d_0$, between the centers of a pair of innermost drivers according to the formula $$d_0=c/2f$$

wherein c is the speed of sound and f is the maximum desired operational frequency with out high amplitude side lobes, selecting a center point in the line, wherein the center point is the same position on the line as $d_0/2$, and determining the spacing of at least one additional pairs of drivers in the line added to the outermost positions of the line, wherein the distance, $d_n$, between the centers of the additional pairs of drivers is according to the formula $$d_n=4nd_0$$

where n=0 at the innermost pair of drivers and n increases by 1 with each pair of drivers sequentially added along the array. The pairs of drivers are used in conjunction with low pass filtering of the first order. The outermost at least one additional pairs of drivers have a lower low pass filter frequency as compared to the calculated frequency for that pair of drivers.

BRIEF DESCRIPTION OF THE DRAWINGS

The present invention will be more clearly understood from a reading of the following description in conjunction with the accompanying figures wherein.

DETAILED DESCRIPTION OF THE INVENTION

The present invention provides a more uniform pattern of sound emanating from loudspeakers, especially the higher frequency sound. The emanating sound is more controlled vertically, up and down; but not horizontally, to the sides. As a result, the sound is cast directly to the audience, and uncluttered with reflections of sound from surfaces above and below the line array.

Figure 1:
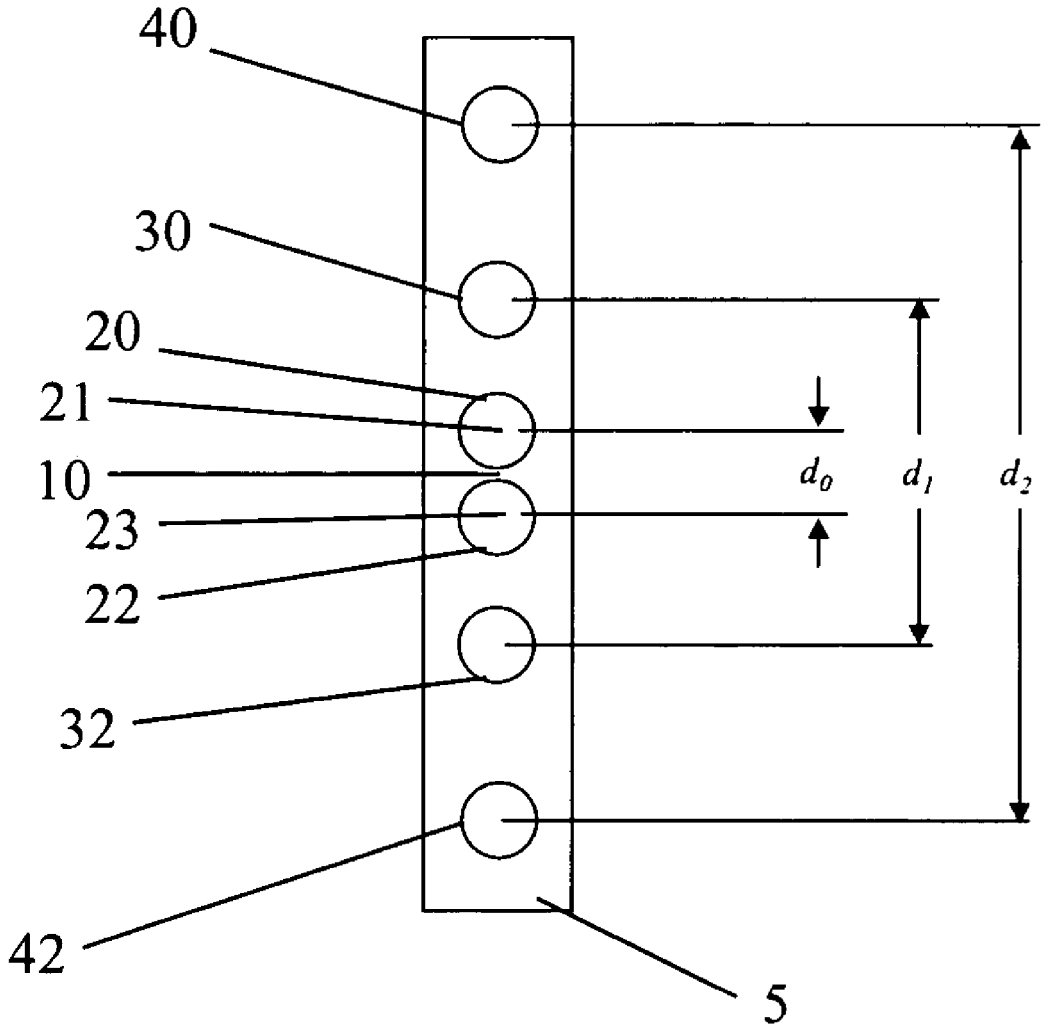
FIG. 1 shows drivers in a line array according to an embodiment of the present invention.

The structure of the present invention comprises a plurality of drivers, arranged in pairs and symmetrically spaced about the central point on a line array. The drivers are conventional drivers known in the art of loudspeaker technology. FIG. 1 shows a loudspeaker arrangement with six drivers (3 pairs of drivers) 20, 22, 30, 32, 40, and 42 on baffle 5. It is also possible to have a single driver located at the central point 10 on the line. However, all other drivers should be present in pairs.

The spacing of the drivers is critical to the success of the present invention. Located substantially at the center of the array is center point 10. The drivers are spaced longitudinally about center point 10. The innermost pair of drivers 20, 22 are spaced equidistant from center point 10 by a distance of $d_0/2$, where $d_0$ is measured from center points 21, 23 of the innermost drivers 20, 22. The spacing between the innermost pair of drivers, $d_0$, determines the uppermost frequency to which the array will function without the effects of comb filtering as one moves off-axis, i.e., reducing high amplitude side lobes. This frequency, f, may be determined as $$f=c/2d_0 \quad (1)$$

where c is the speed of sound.

Subsequent pairs of drivers should be spaced along the line according to the equation $$d_n=4nd_0 \quad (2)$$

where n=1, 2, 3, etc, such that n=0 at the innermost pair of drivers 20, 22 and n increases by 1 with each pair of drivers sequentially added along the array. In accordance with this spacing formula, the next most innermost drivers 30, 32 have a center to center distance of $d_1$, where n=1 and $d_1=4d_0$. Accordingly, the next set of driers 40, 42 have a center to center spacing of $d_2$, where n=2 and $d_2=8d_0$. The preferred embodiment has six drivers for each loudspeaker baffle, although any number of drivers may be present.

The preferred embodiment of the present invention is a speaker with six drivers. Two arrangements of drivers may be used substantially in parallel for a combined at least twelve drivers. The frequency filtering system of the preferred embodiment beams intense, concentrated audio with high directionality, without reverb from floors and ceilings. The preferred embodiment may be used with a personal computer, a television, a game console, or a portable audio device such as a CD player, mp3 player, a DVD player, a mixing console or any other electronic source of sound.

Figure 1A:
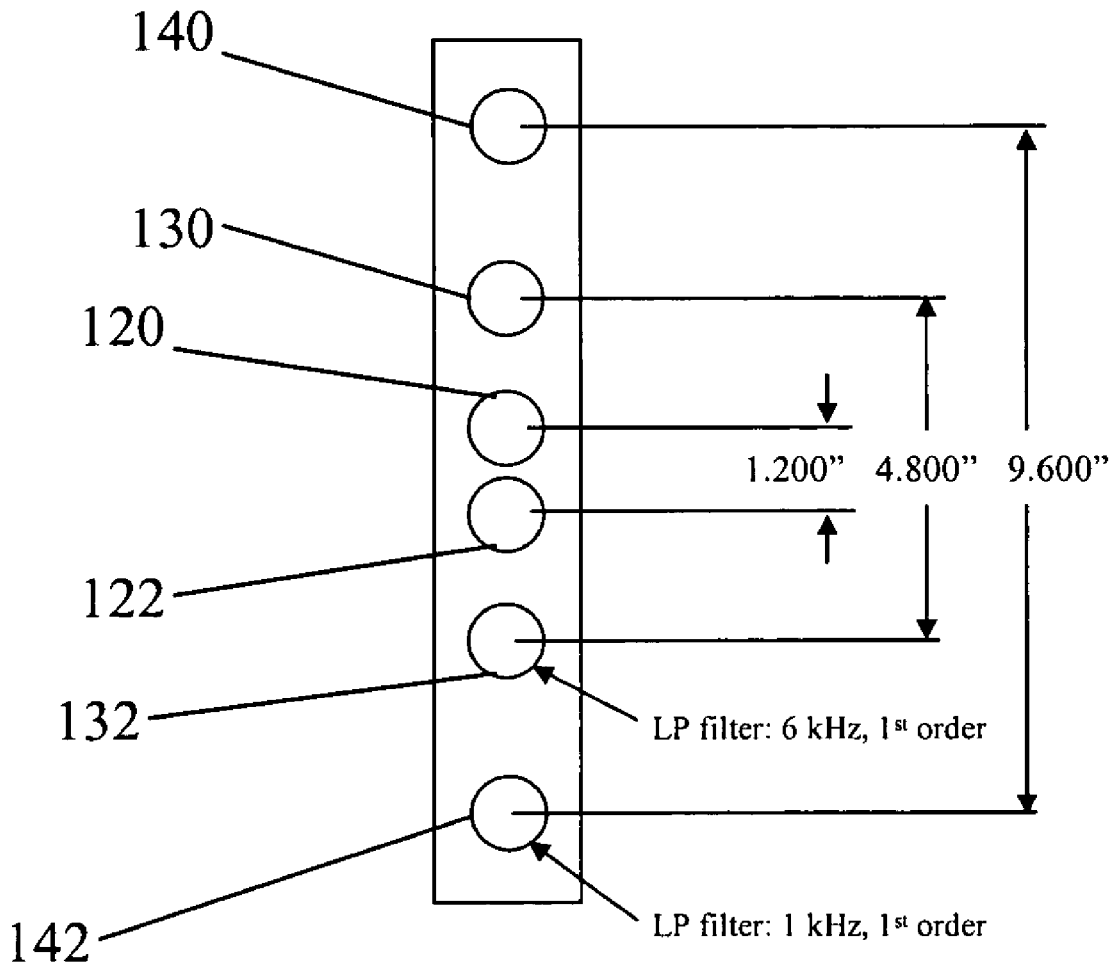
FIG. 1*a* shows drivers in a line array according to an embodiment of the present invention.
Figure 1B:
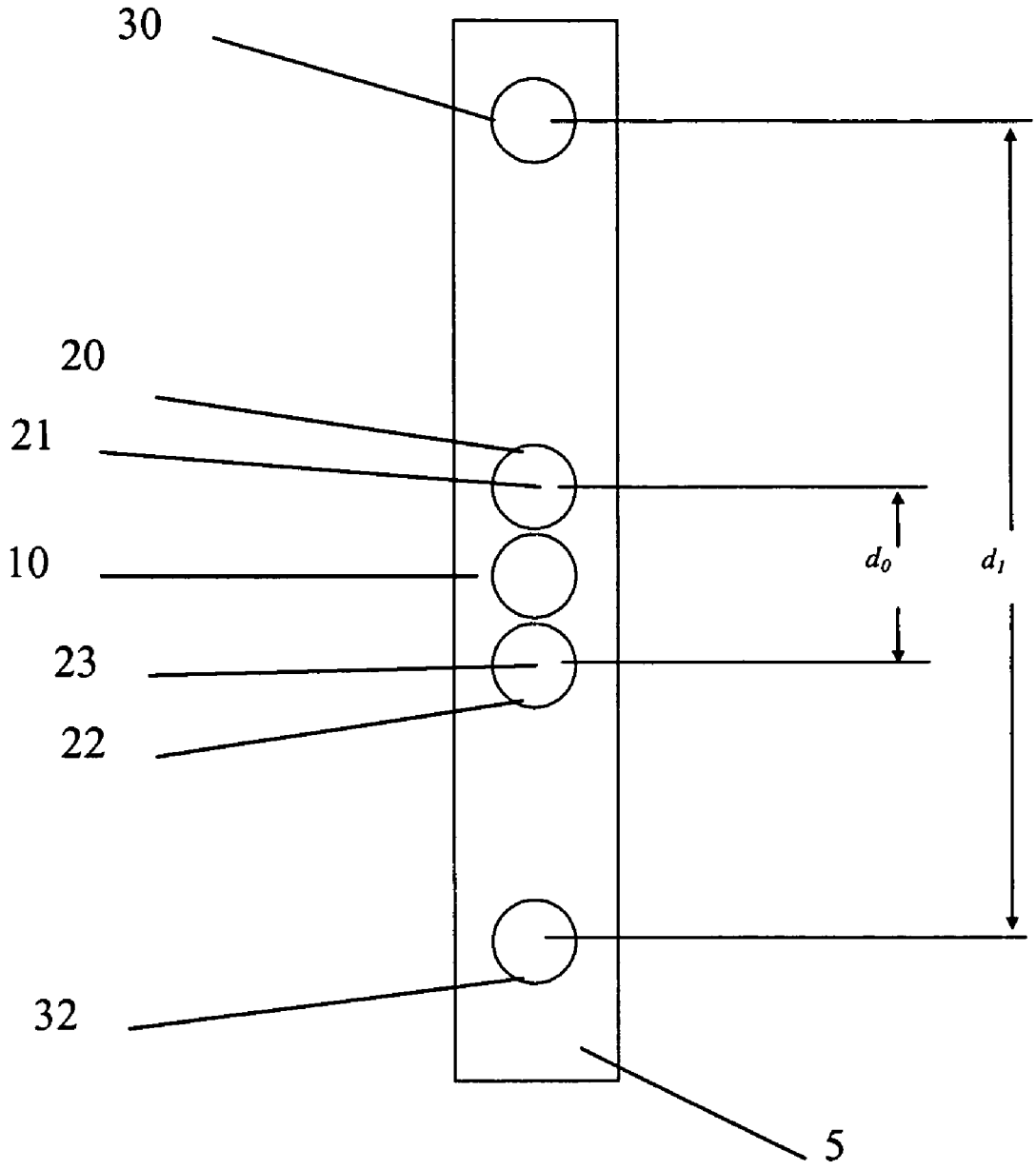
FIG. 1*b* shows drivers in a line array according to an embodiment of the present invention.

FIG. 1*a* exemplifies a driver arrangement of the preferred embodiment of the present invention. For the preferred embodiment, the two innermost drivers 120, 122 have a center to center distance, $d_0$, of 1.200 inches and the drivers 120, 122, 130, 132, 140, and 142 each have a radius of approximately 0.4 inches. Since $d_0$ is 1.200", the next two innermost drivers 130, 132 have a center to center distance of 4.800". The outermost drivers 140, 142 have a center to center distance of 9.600".

In an embodiment of the present invention, the pairs of drivers for which n>0 each have a low pass filter, preferably of first order. A first order filter will allow a signal roll off of 6 dB per octave. A second order low pass filter, however, attenuates at a greater rate at high frequencies. The second order filter will allow a signal roll off of 12 dB per octave. The frequency of the filter is determined according to the following equation:

$$f_n=2c/d_n \quad (3)$$

Accordingly, drivers 130, 132 have a first order low pass filter of 6 kHz. Drivers 140, 142 have a first order low pass filter of 2 kHz. As calculated in equation (1), the frequency below which no side lobes occur is 5650 Hz. The overall directional characteristics of the array improve when the frequency of the low pass filter for the outermost pair of drivers is decreased by a factor of two. In this embodiment, drivers 140, 142 would have the low pass filter frequency decreased to 1 kHz. This sacrifices some of the directivity control at lower frequencies in order to suppress the amplitude of side lobes at higher frequencies. By decreasing the low pass filter frequency of the outermost pair of drivers, the amplitude of the side lobes is acceptable to well above the frequency of 5650 Hz. It is preferred to have the frequency of the low pass filter of the outermost drivers lower than the frequency as calculated for those drivers in equation (3).

Figure 2:
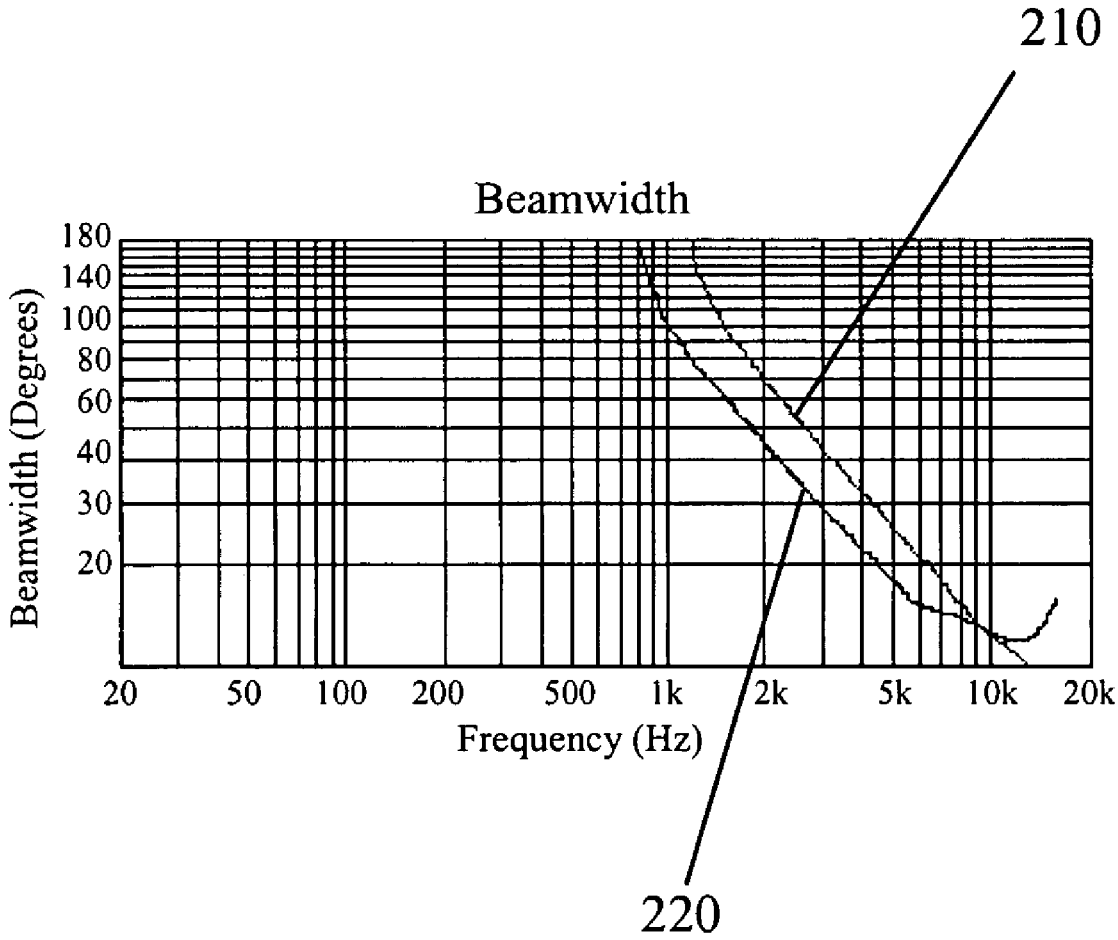
FIG. 2 shows a plot of beamwidth according to an embodiment of the present invention.

The present invention achieves higher directivity through a smaller beamwidth. FIG. 2 shows the increase in directivity control, i.e., smaller beamwidth, of the proposed 4n spacing compared to equally spaced drivers. Beamwidth line 210 represents six equally spaced drivers without low pass filtering. Beamwidth line 220 represents six 4n spaced drivers without low pass filtering. The 4n spaced drivers exhibit more desirable beamwidth properties substantially across the frequency range.

Figure 3:
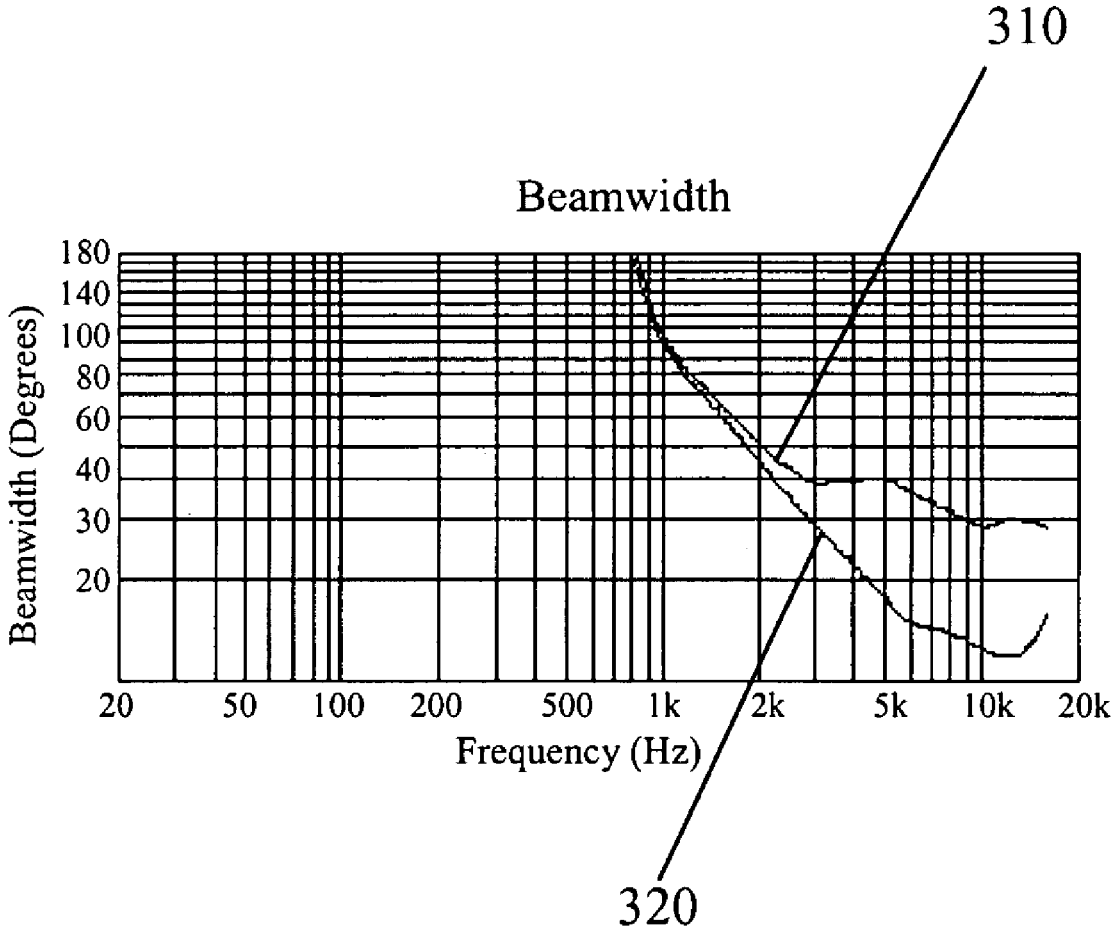
FIG. 3 shows a plot of beamwidth according to an embodiment of the present invention.

FIG. 3 illustrates the advantages of low pass filtering on the directivity. Beamwidth line 310 represents six 4n spaced drivers with low pass filtering. Beamwidth line 320 represents six 4n spaced drivers without low pass filtering. The lower frequency directivity control is relatively unchanged, while the higher frequency directivity as a result of low pass filtering is more linear, i.e., consistent.

Figure 4:
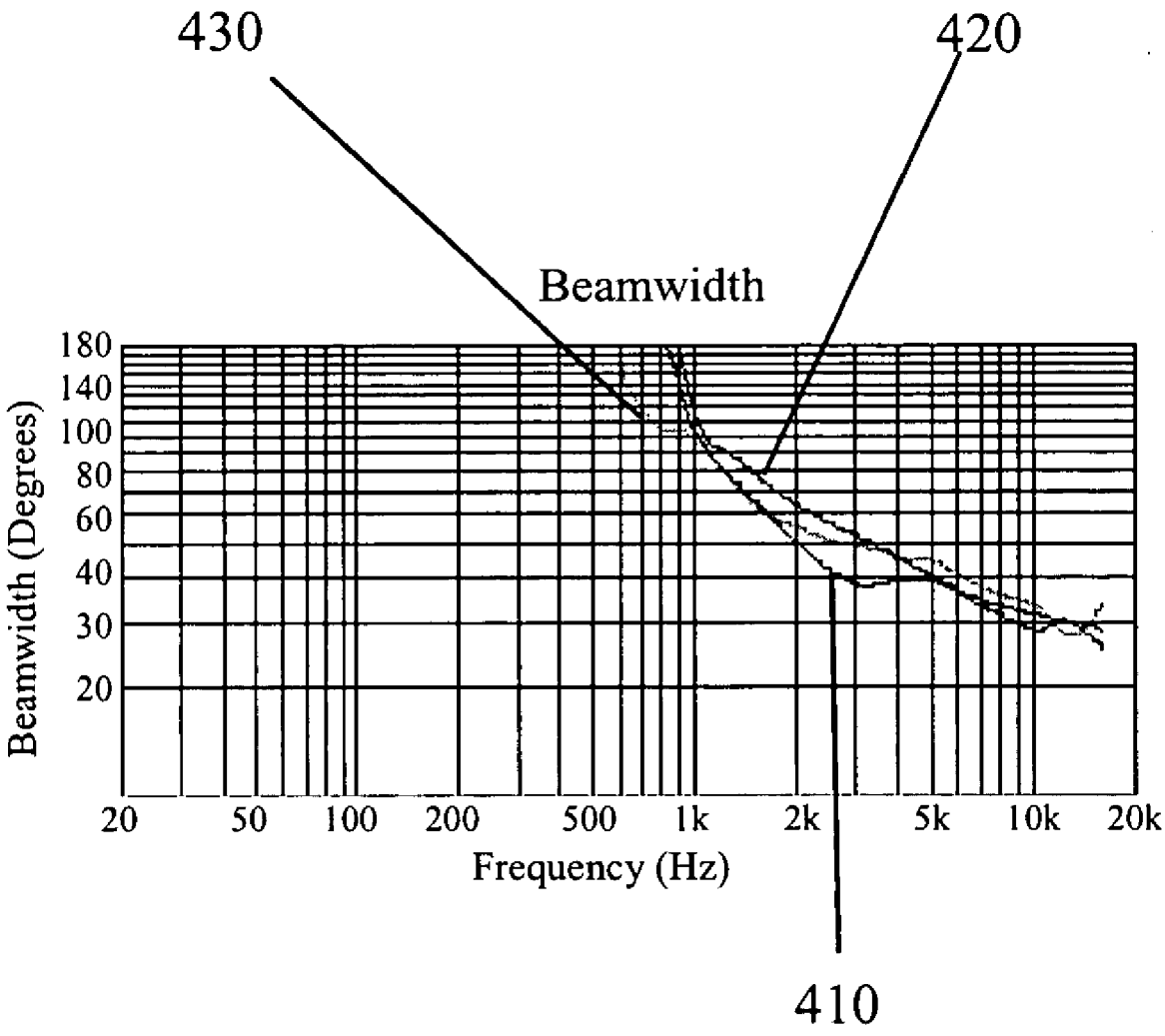
FIG. 4 shows a plot of beamwidth according to an embodiment of the present invention.

FIG. 4 compares directivity performance of the proposed driver spacing. Beamwidth line 410 represents a simulation of six 4n spaced sources with low pass filtering according to an embodiment of the present invention. Beamwidth line 420 represents a simulation of the device with a lowered frequency of the low pass filter of the outermost pair of drivers. Beamwidth line 430 represents an actual measurement of a sample device. The measurement shows an increase in directivity control in the low frequency region of the sample device as compared to the simulation with the lowered frequency filter. This is expected due to a larger baffle of the sample device. The simulations do not take the size of the baffle into account.

The embodiments described herein are intended to be exemplary, and while including and describing the best mode of practicing, are not intended to limit the invention. Those skilled in the art appreciate the multiple variations to the embodiments described herein which fall within the scope of the invention.

What is claimed is:

1. A loudspeaker system having a line array of drivers comprising:

a first pair of drivers configured to receive a signal from a sound source;

a center point along the line array, wherein the first pair of drivers are substantially centered about the center point with a center to center distance of $d_0$ between the first pair of drivers;

at least a subsequent pair of drivers arranged in the line array with the first pair of drivers and substantially centered about the center point, wherein the subsequent pair of drivers are spaced such that the center to center distance between each at least a subsequent pair of drivers, $d_n$, is equal to $4nd_0$, where n=0 at the first pair of drivers and n increases by 1 for each at least a subsequent pair of drivers, wherein a low pass filter is associated with each of the at least a subsequent pair of drivers, and wherein the corner frequency, $f_n$, of each such low pass filter is equal to $2c/d_n$, where c is the speed of sound.

2. The loudspeaker system of claim 1, wherein each low pass filter is of first order.

3. The loudspeaker system of claim 1, further comprising an outermost pair of drivers in the array, wherein the low pass filter on the outermost pair of drivers in the array has a corner frequency calculated by $f_n=c/d_n$.

4. The loudspeaker system of claim 1, further comprising a driver centered on the center point of the line array.

5. A transducer spacing arrangement in an array, the arrangement comprising:

a first pair of transducers having a first distance, $d_0$, between the center points of the transducers in the first pair of transducers, wherein the transducers are configured to receive a signal from a sound source;

a second pair of transducers arranged in the array with the first pair of transducers and having a second distance, $d_1$, between the center points of the transducers in the second pair of transducers, wherein the midpoint of $d_0$ is the same midpoint of $d_1$, and wherein the second distance, $d_1$, is equal to $4d_0$;

a low pass filter of first order on the second pair of transducers, wherein the first pair of transducers receives a signal comprising a first frequency band and the second pair of transducers receives a signal comprising a second frequency band, and wherein the corner frequency, $f_n$, of each such low pass filter is equal to $2c/d_n$, where c is the speed of sound.

6. The transducer spacing arrangement of claim 5, wherein $d_0$ is 1.2 inches, and $d_1$ is 4.8 inches.

7. The transducer spacing arrangement of claim 5, further comprising a transducer at the center point of $d_0$.

8. The transducer spacing arrangement of claim 5, further comprising at least a third pair of transducers, and a low pass filter of first order on the at least a third pair of transducers.

9. The transducer spacing arrangement of claim 8, wherein the outermost pair of transducers in the array has the lowest frequency low pass filter.

10. A method for optimizing a radiation pattern of drivers in a line on a loudspeaker, the method comprising:

selecting a spacing, $d_0$, between the centers of a pair of innermost drivers according to the formula $d_0=c/2f$ wherein c is the speed of sound and f is the maximum desired operational frequency and wherein the pair of innermost drivers receive a signal comprising a frequency band $z_0$;

selecting a center point in the line, wherein the center point is the same position on the line as $d_0/2$; and determining the spacing of at least one additional pairs of drivers in the line wherein each driver of the additional pair of drivers is added to the outermost positions of the line, wherein the distance, $d_n$, between the centers of the additional drivers is according to the formula $d_n=4nd_0$ where n=0 at the innermost pair of drivers and n increases by 1 with each pair of drivers sequentially added along the array, and wherein the at least one additional pair of drivers receive a signal comprising a frequency band $z_n$;

wherein each of the frequency bands $z_0$ through $z_n$ comprise a common frequency band at a common level of attenuation, wherein the at least one additional pair of drivers are used in conjunction with low pass filtering, and wherein the corner frequency, $f_n$, of the low pass filters for each pair of drivers is calculated according to the ecluation $f_n=2c/d_n$.

11. The method of claim 10, wherein the low pass filtering is of the first order.

12. The method of claim 10, further comprising selecting an outermost pair of drivers for the array, wherein the low pass filter for the outermost pair of drivers has a corner frequency calculated by the equation of $f_n=c/d_n$.

13. The method of claim 10, wherein the maximum desired operational frequency is substantially the highest frequency without high amplitude side lobes.

* * * * *